US005911179A

United States Patent [19]

Spiczka

[11] Patent Number: 5,911,179

[45] Date of Patent: Jun. 15, 1999

[54] PALLET AND METHOD FOR USING SAME

[75] Inventor: Darrell Spiczka, Princeton, Minn.

[73] Assignee: Storage Technology Corporation, Louisville, Colo.

[21] Appl. No.: 08/900,249

[22] Filed: Jul. 25, 1997

[51] Int. Cl.[6] ..... B65D 19/00

[52] U.S. Cl. ..... 108/51.11; 108/57.12; 108/57.16; 206/320; 193/41; 193/38

[58] Field of Search ..... 108/51.11, 52.1, 108/57.12, 57.15, 57.16, 57.17, 55.3, 55.1; 248/346.02, 345.1; 206/320; 193/41, 38

[56] References Cited

U.S. PATENT DOCUMENTS

| | | | |
|---|---|---|---|
| 2,570,757 | 10/1951 | Bowman et al. | 108/52.1 X |
| 2,815,252 | 12/1957 | Baker | 193/38 X |
| 3,478,526 | 11/1969 | Foster | 193/38 X |
| 3,753,407 | 8/1973 | Tilseth | 108/55.3 X |
| 4,295,431 | 10/1981 | Stavlo | 108/55.1 |
| 4,397,246 | 8/1983 | Ishida et al. | 248/346.02 X |
| 4,911,084 | 3/1990 | Sato et al. | 108/57.17 |
| 5,505,140 | 4/1996 | Wittmann | 108/51.11 |

FOREIGN PATENT DOCUMENTS

| | | | |
|---|---|---|---|
| 4118522 | 12/1992 | Germany | 108/55.3 |

*Primary Examiner*—Peter M. Cuomo
*Assistant Examiner*—Janet M. Wilkens
*Attorney, Agent, or Firm*—Brooks & Kushman P.C.

[57] ABSTRACT

A pallet including a ramp and two slide assemblies inserted between the pallet surface and the article to be shipped. The ramp is pivotally attached as part of the pallet structure and may be folded up during shipping and down during unloading. The slide assemblies include a strip of material with a low coefficient of friction to facilitate sliding on the pallet surface and the ramp.

3 Claims, 3 Drawing Sheets

PALLET AND METHOD FOR USING SAME

BACKGROUND OF THE INVENTION

1. Field of the Invention

The invention relates to the field of packaging and shipping. More particularly, the invention relates to the field of pallets. In still greater particularity, the invention relates to a pallet with an included ramp for unloading an item from the pallet. By way of further characterization, but not by way of limitation thereto, the invention includes low friction slides which allow the item to slide down the ramp and onto a surface.

2. Description of the Related Art

Pallets are widely used for transporting relatively large and or heavy articles. The pallet allows the use of a forklift for ease in loading and unloading. The pallet also increases the strength of the shipped article such that there is less likelihood of damage to the article during shipping. Electronic or computer related equipment is often uncrated and installed in relatively small computer rooms or laboratories. In such situations, one or more individuals must uncrate the article and remove it from the pallet. For large or heavy items this can be a difficult task for one or two persons.

Conventional pallets do not allow for the easy removal of the item from the pallet. In many instances 6 or more people are required to lift and slide or "walk" computer equipment off a pallet and onto the floor or other surface. Because of the difficulty associated with this process, damage may occur to the item to be unloaded. Use of this many personnel is also not cost effective and results in a waste of resources.

SUMMARY OF THE INVENTION

The invention is a pallet which includes a ramp and low friction slides to permit easy unloading of an item form the pallet. The ramp is pivotally attached to the front of the pallet to allow it to fold up against the shipped article during transport. The pallet also includes low friction slides to allow the item to slide easily off the pallet and sown the ramp onto a surface. The pallet also includes shock absorbing material built into the pallet to provide for shock absorption.

DESCRIPTION OF THE PREFERRED EMBODIMENT

Figure 1:
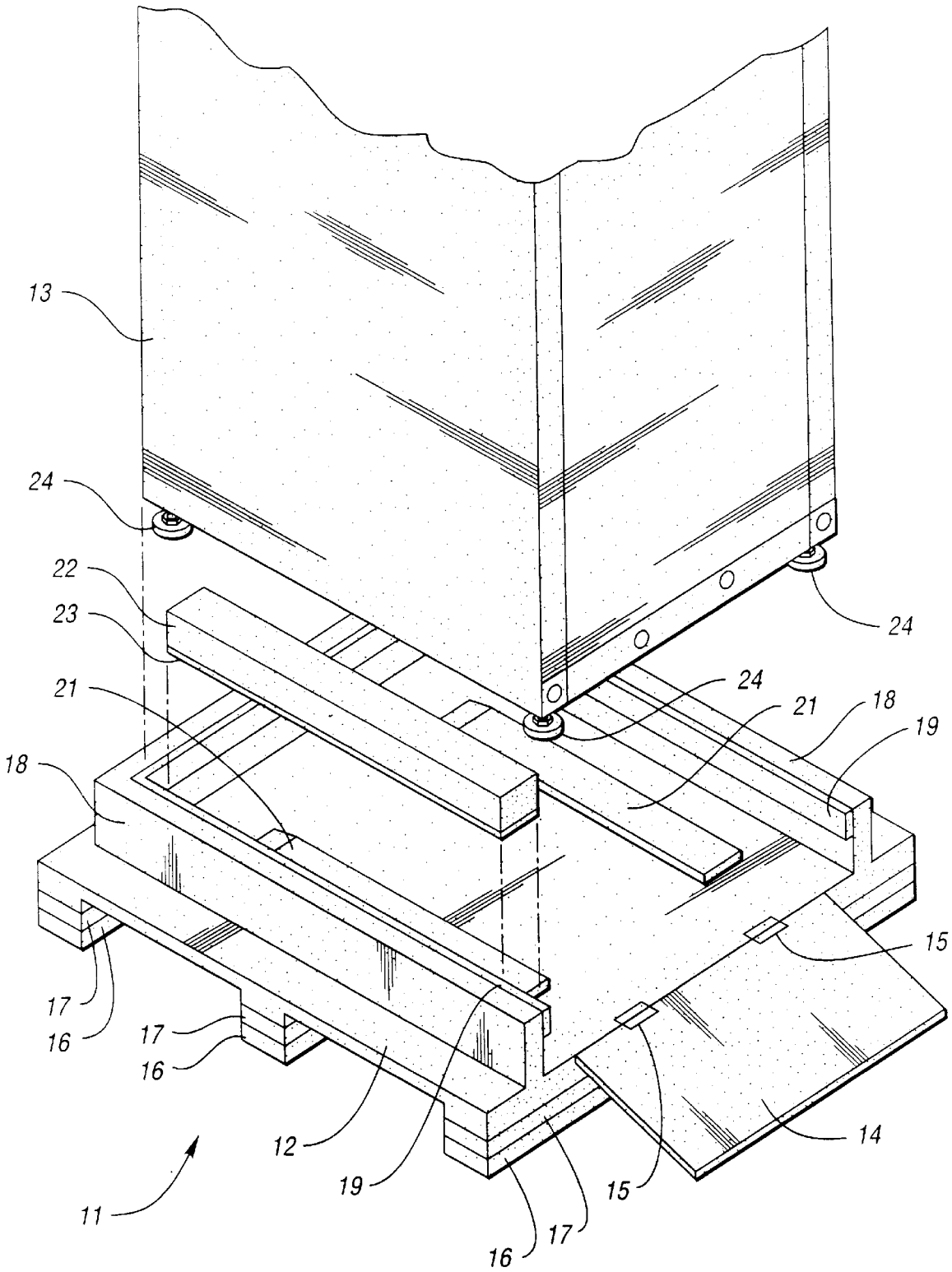
FIG. 1 is a front perspective view of the pallet.

Referring now to the drawings wherein like reference numerals denote like structure throughout each of the various figures, FIG. 1 is a perspective view of the pallet 11 of the present invention. Referring to FIG. 1, pallet 11 includes supporting structure 12 upon which an article 13 to be transported rests. Article 13 may be, for example, a seismic cabinet described in copending application U.S. Ser. No. 08/900,248 (Docket no. 97-054-NSC) filed on even date herewith and assigned to a common assignee. That application is hereby incorporated by reference as if fully set forth herein.

Pallet 11 includes a ramp 14 pivotally connected to support structure 12 by hinges 15 or other suitable means. Supporting structure 12 is itself supported by legs 16. Legs 16 include a shock absorbing layer 17. That is, while structure 12 and legs 16 are preferably made of wood or other suitable material, shock absorbing layer 17 is preferably high density styrofoam or other suitable shock absorbing material as will be apparent to one skilled in the art. The inclusion of shock absorbing layer 17 provides greater protection for article 13 during shipping if pallet 11 and article 13 are subjected to seismic forces, rough handling or other environmental stresses.

Pallet 11 includes guide rails 18 on three sides of the pallet to prevent article 13 from unintended slipping off of pallet 11 during transport. Guide rails 18 include protective strips 19 on the inside of rails 18. Strips 19 are made of high density polyethylene or other suitable material to prevent damage to article 13 where it comes into contact with strips 19. Pallet 11 also includes guide strips 21 attached to supporting structure 12 to prevent unintended side movement of article 13 during shipping or during removal of article 13 from the pallet. Two slide assemblies 22 are included, one on each side of pallet 11. Only one slide assembly is shown in FIG. 1 for ease of illustration. Slide assembly includes a low friction strip 23 on the underside of assembly 22. Low friction strip may be made of high density polyethylene, nylon, teflon or other suitable material as will be known to one skilled in the art. Low friction strip 23 contacts the surface of supporting structure 12 to facilitate sliding of article 13 off of structure 12. Slide structure 22 f its between leg portions 24 of article 13.

Figure 3:
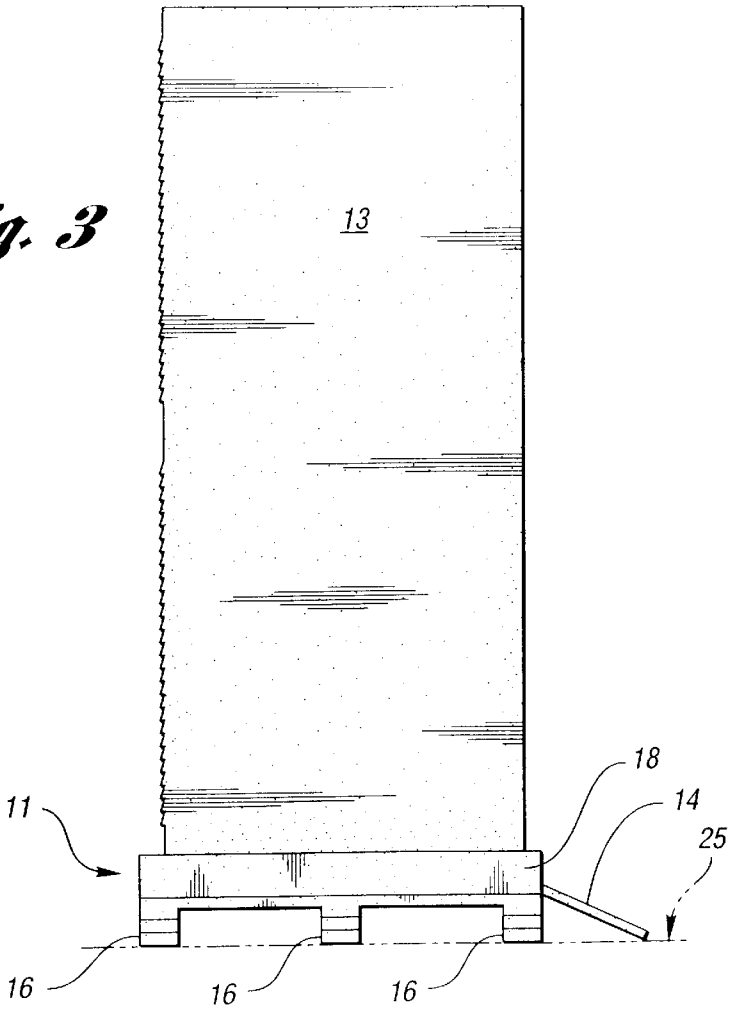
FIG. 3 is a side view of the article on the pallet with the ramp lowered.
Figure 2:
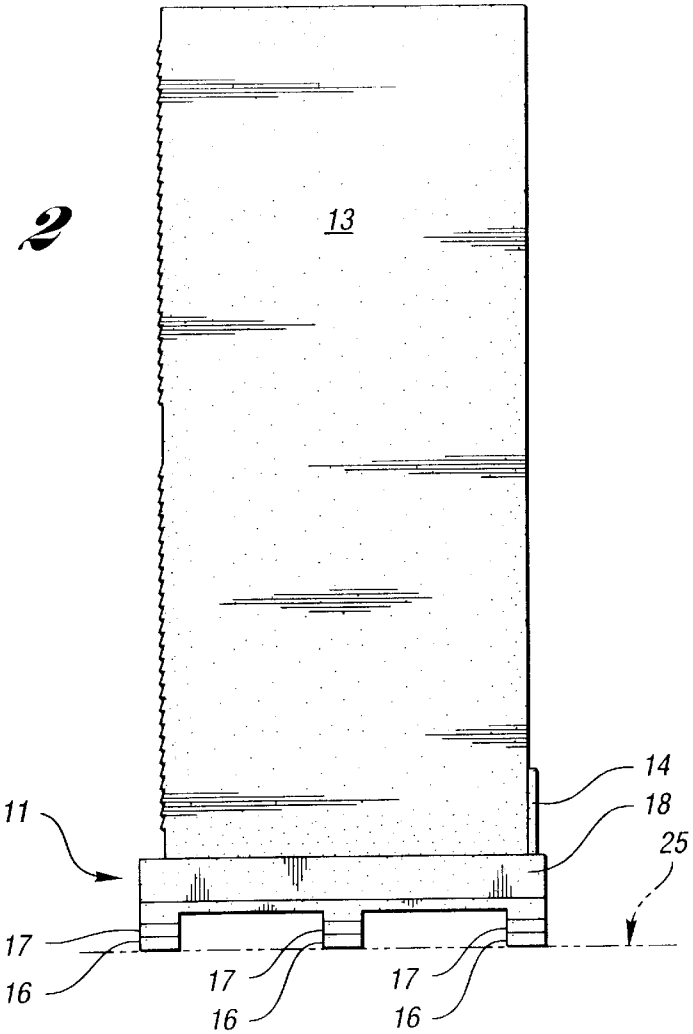
FIG. 2 is a side view of the pallet and the article as shipped.

FIGS. 2–5 illustrate the sequence of steps in removing article 13 from pallet 11 and onto a surface 25. Referring to FIG. 2, pallet 11 is placed onto surface 25. The carton (not shown) which encloses article 13 and a potion of pallet 11 during shipping is removed. Ramp 14 is pivoted in an up position against article 13. Referring to FIG. 3, ramp 14 is pivoted down into contact with surface 25.

Figure 4:
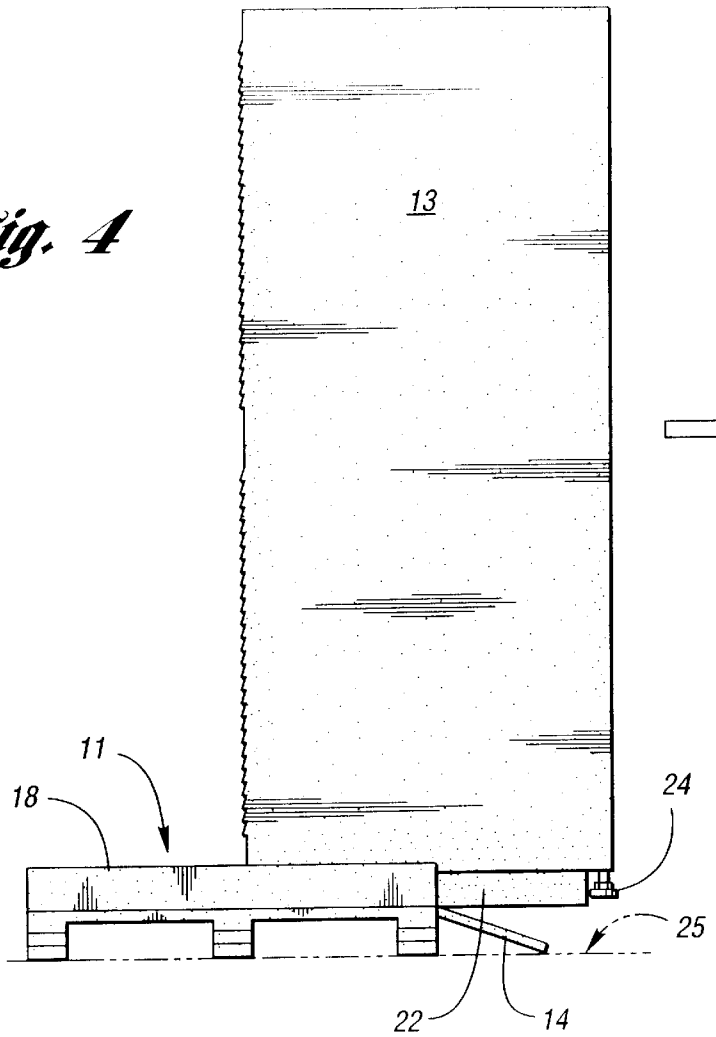
FIG. 4 is a side view of the article in the process of being slid off the pallet.

Unlike prior art pallets, the pallet of the present invention requires only two persons to unload a large and/or heavy article 13 from the pallet. Referring to FIG. 4, a first person (not shown) pushes article 13 in the direction shown toward ramp 14. Because of the low friction strip 23 on slide assembly 22, one person is able to push even heavy articles 13 with relative ease. A second person (also not shown) provides countervailing support in front of the article 13 to prevent unintended tipping of article 13 as it is being slid from pallet 11.

Figure 5:
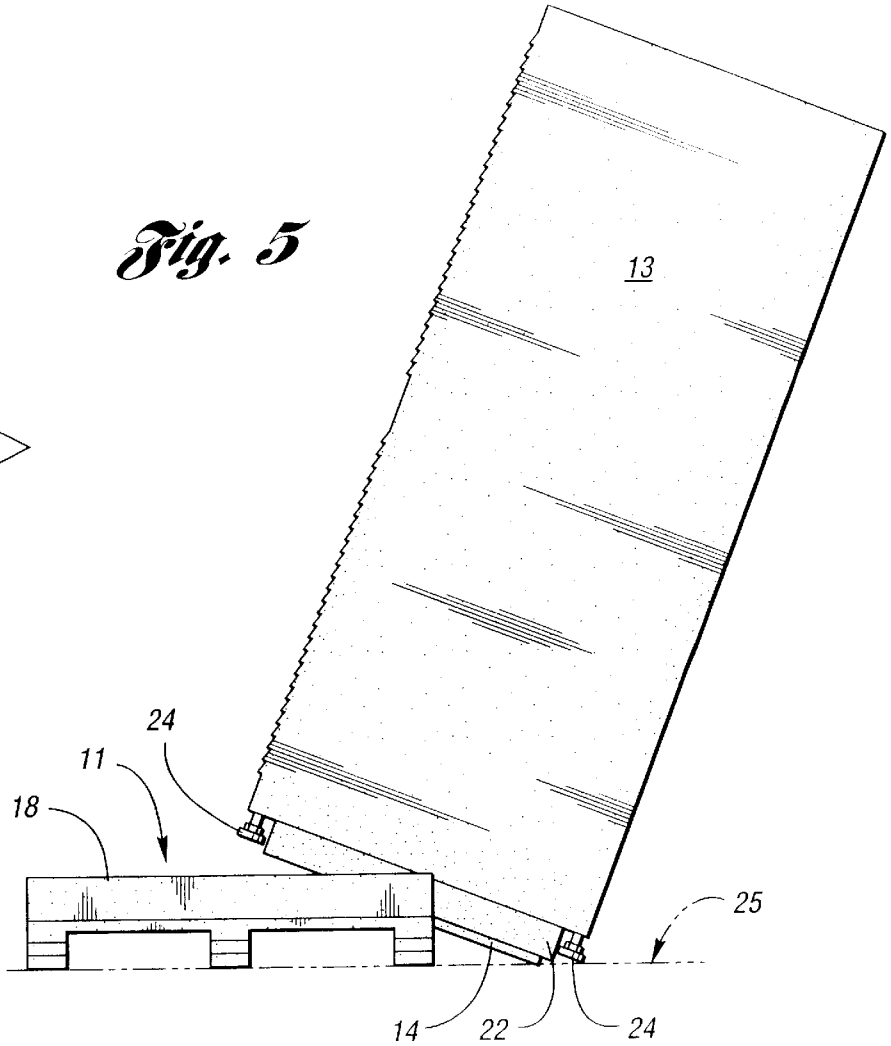
FIG. 5 is a side view of the article having been slid down the pallet ramp onto a surface.

Referring to FIG. 5, once article 13 slides far enough such that the majority of its weight extends over the front of pallet 11, the second person allows article 13 to tip onto ramp 14 where, still resting on slide assembly 22, it is allowed to slide down ramp 14 until slide assembly 22 or leg portions 24 contact surface 25. Slide assembly 22 is held in place under article 13 by the combination of being held between leg portions 24 and the frictional resistance between slide assembly 22 and article 13. Low friction strip 23 ensures that the frictional drag between slide assembly 22 and the surface of support structure 12 is less than the frictional drag between slide assembly 22 and article 13.

Once article 13 is in the position shown in FIG. 5, the first person may tip article 13 forward a small amount while the second individual pulls pallet 11 out from under article 13. Article 13 is then resting on slide assemblies 22 which are themselves resting on surface 25. Article 13 may then be tilted to one side and one of slide assemblies may be removed. That side of article 13 is then lowered and leg portions 24 on that side of article 13 are thereby allowed to contact surface 25. This step is repeated on the other side of article 13 such that the four leg portions of article 13 are now resting on surface 25.

Because of the incorporation of ramp 14 and slide assemblies 22 with low friction strips 23 into pallet 11, article 13 may be offloaded by two or there individuals rather than requiring up to six persons for safe unloading as with prior art pallets. The inclusion of shock absorbing material in layer 17 of the pallet adds to the shipping capability of the pallet. As noted in the copending application referenced above and incorporated by reference herein, meeting shipping requirements is important when valuable and structurally delicate electronic equipment is contained in a cabinet (article 13).

While the invention has been disclosed with respect to a preferred embodiment thereof changes and modifications may be made which are within the full intended scope of the invention as defined by the appended claims. For example, the choice of materials to be used in construction of the pallet is one of design consideration to be made by one skilled in the art given the teaching of my invention. Wood is the primary material used in the construction of the pallet. However, plastic or metal could be substituted for example. Shock absorbing layer 17 is high density styrofoam but other shock absorbing materials could be substituted. Similarly, other low friction materials could be substituted for layer 23. For example, nylon, teflon, or other plastics or metals could be used.

What is claimed is:

1. A pallet assembly adapted to hold an article, the pallet assembly comprising:

a support structure on which said article may rest, said support structure having guide rails vertically extending thereon to substantially limit lateral movement of said article, wherein the guide rails include protective strips attached along vertical portions thereof;

a ramp pivotally attached to said support structure; and a slide assembly insertable between said support structure and said article so as to contact a surface of said support structure and said article, said slide assembly including a strip of material attached to said slide assembly, said strip of material having a coefficient of friction which is lower than said surface of said support structure;

whereby said article may slide on said support structure and said ramp.

2. A pallet according to claim 1 wherein said support structure includes a shock absorbing layer.

3. A method for unloading an article from a support structure of a pallet comprising the steps of:

a) sliding said article in a first direction on two slide assemblies inserted between said support structure and said article so as to contact a surface of said support structure and said article, said article being substantially limited from lateral movement in a second direction transverse to said first direction by vertically extending guide rails provided on said support structure, said guide rails having protective strips attached along vertical portions thereof, each said slide assembly including a strip of material attached to said slide assembly, said strip including a material having a coefficient of friction which is lower than said surface of said support structure;

(b) further sliding said article on a ramp included in said support structure until either said slide assemblies or said article contacts a surface;

(c) tilting said article such that said article does not contact said support structure;

(d) removing said support structure;

(e) tilting said article such that said article does not contact one of said slide assemblies;

(f) removing one of said slide assemblies; and (g) repeating steps e and f for the other of said slide assemblies.

* * * * *